US005562284A

United States Patent [19]

Stevens

[11] Patent Number: 5,562,284

[45] Date of Patent: Oct. 8, 1996

[54] GAME TICKET WITH MULTIPLE-LEVEL EXPOSURE DEVICE

[75] Inventor: Mark Stevens, Omaha, Nebr.

[73] Assignee: International Gamco, Inc., Omaha, Nebr.

[21] Appl. No.: 430,353

[22] Filed: Apr. 28, 1995

[51] Int. Cl.[6] ..... A63F 3/06; B42D 15/00

[52] U.S. Cl. ..... 273/139; 283/901; 283/903; 283/94

[58] Field of Search ..... 283/901, 903, 283/117, 94, 101, 103, 100; 273/139, 138 R

[56] References Cited

U.S. PATENT DOCUMENTS

| | | | |
|---|---|---|---|
| 3,900,219 | 8/1975 | D'Amato et al. | 273/139 |
| 3,940,124 | 2/1976 | Johnsen | 273/139 |
| 4,033,611 | 7/1977 | Johnsen | 283/901 |
| 4,174,857 | 11/1979 | Koza | 283/6 |
| 4,740,016 | 4/1988 | Konecny et al. | 283/903 |
| 4,846,504 | 7/1989 | MacGregor et al. | 283/102 |
| 4,943,090 | 7/1990 | Fienberg | 273/139 |
| 5,106,090 | 4/1992 | Greenwood | 273/139 |
| 5,217,258 | 6/1993 | Sanderson | 283/105 |
| 5,253,899 | 10/1993 | Greenwood | 283/106 |

FOREIGN PATENT DOCUMENTS

| | | | |
|---|---|---|---|
| 2075918 | 11/1981 | United Kingdom | 283/903 |

OTHER PUBLICATIONS

Double Press, Inc., "Double Zero's," 1987.
Double Press, Inc., "Bank 200/250," 1989.

*Primary Examiner*—Benjamin H. Layno
*Attorney, Agent, or Firm*—Pretty, Schroeder, Brueggemann & Clark

[57] ABSTRACT

Disclosed is a game ticket with a base card displaying play results on a playing surface, an inner exposure device, and an outer exposure device. The inner exposure device is located so as to conceal at least one of the play results, and is removable to reveal the play results it conceals. The outer exposure device is located so as to conceal both the inner exposure device and the play results not covered by the inner exposure device, and is removable to reveal the inner exposure device and play results that it conceals.

6 Claims, 2 Drawing Sheets

GAME TICKET WITH MULTIPLE-LEVEL EXPOSURE DEVICE

BACKGROUND OF THE INVENTION

1. Field of the Invention

This invention relates to an article of manufacture. In particular, the invention relates to a game ticket comprising a plurality of play results being concealed and provided to players on the ticket.

2. Discussion of the Relevant Art

Game tickets provide both a popular form of entertainment to players of the game and a source of income to providers of the tickets. These providers include state governmental bodies, charities, and private organizations. The providers may sell the tickets, or they may distribute them as promotions.

For players, the greater the entertainment value of the game ticket, the more they enjoy playing the game. For providers, the greater the entertainment value of the ticket, the more effective the ticket is in generating ticket sales or promotional effects. For providers selling the tickets in conjunction with other products or services, the entertainment value of the tickets also provides an incentive to bring in players, who in turn use the other products or services. Thus the entertainment value of a ticket is directly related to the successful use of game tickets.

Accordingly, modifications of game tickets that provide enhanced entertainment value can benefit both the players and the providers. Therefore, it is a desideratum to design game tickets with novel features to enhance the entertainment value of the tickets.

A popular form of game ticket consists of an exposure device concealing printed indicia of one or more play results, until the exposure device is removed. Cover sheets containing pull-tabs and scratch-off surfaces are two common forms of exposure devices. For a pull-tab, exposure entails opening the pull-tab to display the play result or results lying underneath. For a scratch-off surface, exposure entails scraping off a portion of the surface to display the play result or results lying underneath. Words or pictures are generally drawn on the outer surface of the exposure devices. These markings are to guide and encourage the player in using the ticket.

Once exposed, a play result displays the value of the play. Different types of play results present the results in different formats. For example, a direct play result presents the value explicitly by showing the prize, if any. Other types of play results depict an encoded value, which must be interpreted. A common example of an encoded play result is a plurality of symbols associated with the display of a slot machine. Certain combinations of symbols correspond to winning plays.

The entertainment value of a game ticket is difficult to predict, and, thus, there is no formula for designing successful game tickets. Accordingly, there has existed a definite need for game tickets having enhanced entertainment value. The present invention provides this and related needs.

SUMMARY OF THE INVENTION

The object of the present invention is to enhance the entertainment value of a game ticket and, thus, the successful use of the game ticket. The invention accomplishes this through the use of novel, multiple-level exposure devices.

Game tickets in accordance with the invention include a base card, a playing surface on the base card, and at least two play results printed on the playing surface. An outer exposure device is located over the playing surface to conceal all of the play results. An inner exposure device is concealed under the outer exposure device. The inner exposure device is located so as to conceal one or more play results. Thus, one or more play results are concealed by both exposure devices. Prior to removal, there is no indication on the outer exposure device where the inner exposure device is located. The invention thus includes at least two play results, wherein some of the results are concealed by more than one exposure device, and wherein prior to removing the outer exposure device it is not apparent which of the results are further concealed by the inner exposure device.

In some embodiments of the invention, the presence of the inner exposure device over a play result indicates that a specific format of play result lies underneath. Thus, all play results concealed by the inner exposure device are of one format, while those not covered by the inner exposure device are of a different format.

DETAILED DESCRIPTION OF THE PREFERRED EMBODIMENTS

Figure 1:
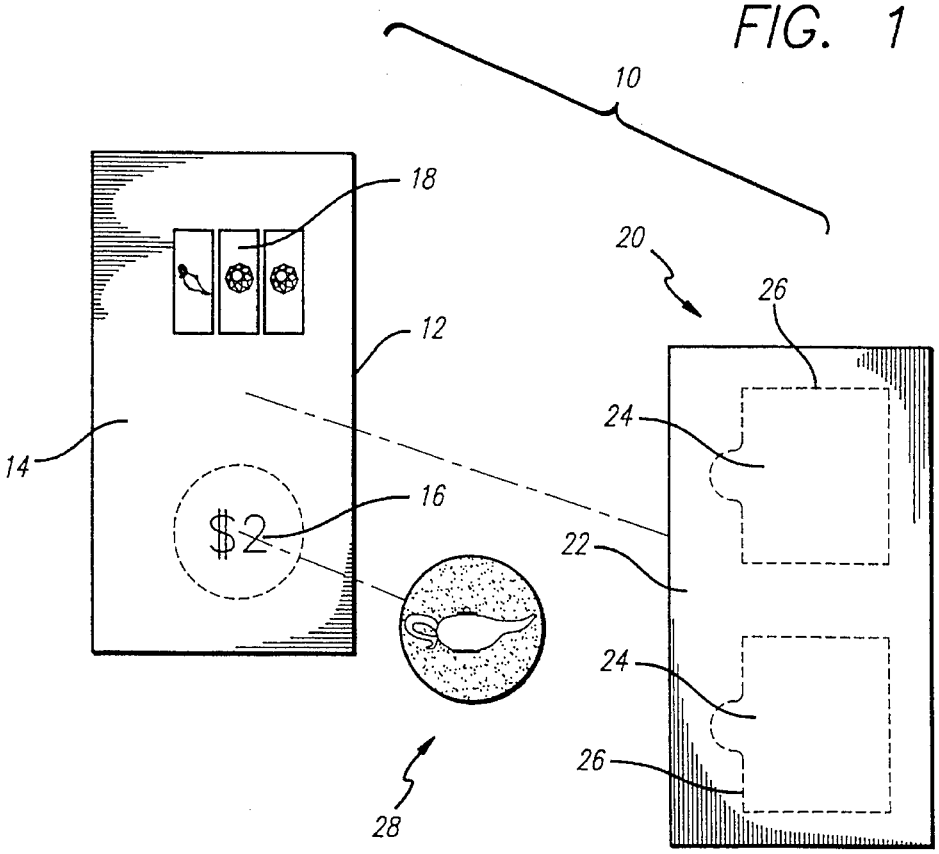
FIG. 1 is an exploded view of one embodiment of a game ticket in accordance with the present invention.

A game ticket 10 according to the present invention is shown in FIG. 1. The game ticket includes a rectangular base card 12 having a playing surface 14. The playing surface has a first play result 16 and a second play result 18 printed thereon.

The first play result 16 is direct play result, displaying a value directly, or stating that the play result has no value. The second play result 18 is encoded, depicting symbols that are associated with a slot machine display.

An outer exposure device 20 is formed by a top card 22 having the same rectangular shape as the base card 12. The top card contains two pull tabs 24 created by perforations 26. The pull-tabs are positioned so that when the top card is affixed to the playing surface 14, the pull-tabs are located above the first and second play results 16 and 18.

An inner exposure device 28 is disposed between the outer exposure device 20 and the playing surface 14. It is formed by a scratchable surface applied to the playing surface to cover the first play result 16, but not the second play result 18. Consequently, when the game ticket 10 is assembled, the first play result is covered by both the outer and inner exposure devices, while the second play result is covered only by the outer exposure device. The inner exposure device includes an image to encourage the player.

Figure 2A:
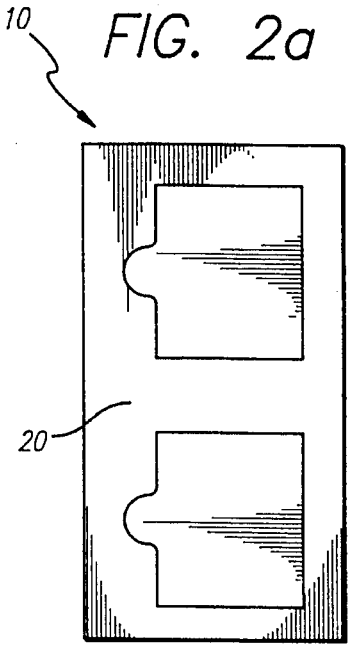
FIG. 2*a* is a top view of the game ticket of FIG. 1.
Figure 2B:
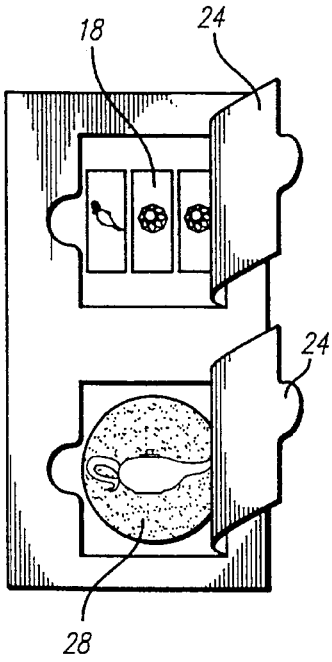
FIG. 2*b* is the same view as FIG. 2*a* after the outer exposure device has been removed.
Figure 2C:
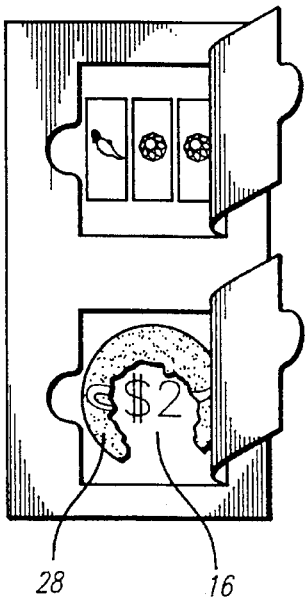
FIG. 2*c* is the same view as FIG. 2*a* after the outer and inner exposure devices have been removed.

FIGS. 2*a–c* show the game ticket 10 during various stages of play. FIG. 2*a* depicts the game ticket in the form in which it is purchased by a player with all of the exposure devices intact. In FIG. 2*b*, the pull-tabs 24 have been opened, exposing the scratchable surface 28 and the second play result 18. To view the first play result 16, the player must remove the scratchable surface, as is seen in FIG. 2*c*. The inner exposure device adds to the entertainment value of the ticket by adding to the anticipation of the award which may lie beneath. After the outer exposure device is removed, the player is rewarded with the knowledge of which format of play result is concealed.

Figure 3:
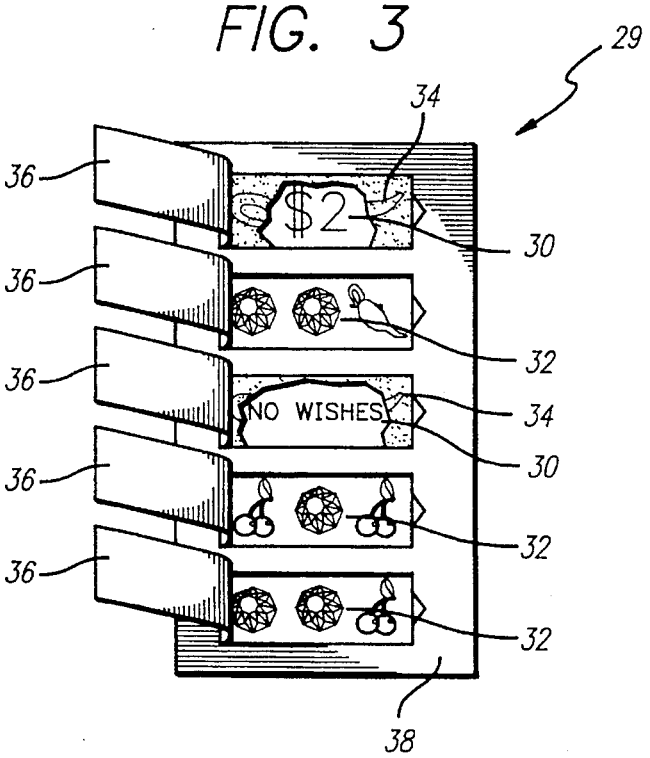
FIG. 3 is a top view of an alternative embodiment of the game ticket after the outer exposure device has been removed.

In the alternate embodiment of the invention shown in FIG. 3, the game ticket 29 contains five play results. The five results include two direct results 30, and three encoded results 32. The direct play results were each covered by a scratchable surface 34. The play results and scratchable surfaces were covered by five pull-tabs 36 formed in a top card 38.

Figure 4:
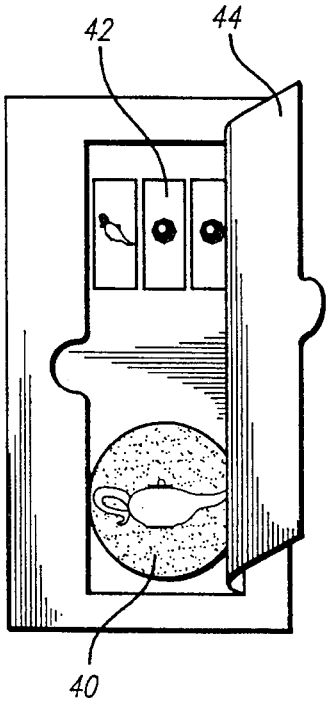
FIG. 4 is a top view of a second alternative embodiment of the game ticket after the outer and inner exposure devices have been removed.

An alternate embodiment of the invention is shown in FIG. 4. In this embodiment, both a first play result shown covered by the scratch-off surface 40 and a second play result 42 are covered by a single pull-tab 44.

From the foregoing, it will appreciated that the present invention provides enhanced entertainment value in game tickets. The game ticket thus provides enhanced enjoyment for players, and enhanced sale and promotional opportunities for game ticket providers.

While a particular form of the invention has been illustrated and described, it will be apparent that various modifications can be made without departing from the spirit and scope of the invention. For example, while the described embodiment includes two specific play result formats, a direct play result format and a slot machine play result format, other formats are within the scope of the invention. Other combinations of disclosure devices, including two levels of the same type of exposure device, are also within the scope of the invention. Furthermore, the invention includes more than two levels of exposure device, such as a pull tab exposing some results and some inner pull tabs, that in turn expose some results and some scratch off surfaces, that in turn expose some results. Thus, although the invention has been described in detail with reference to the preferred embodiments, those having ordinary skill in the art will appreciate that various modifications can be made without departing from the invention. Accordingly, the invention is not intended to be limited, and is defined with reference to the following claims.

I claim:

1. A game ticket comprising:

a base card having a playing surface;

at least two seperate play results displayed on the playing surface;

an inner exposure device, wherein said inner exposure device is located so as to conceal at least one but not all of said play results, said inner exposure device being removable to reveal the play results concealed by said inner exposure device; and an outer exposure device, said outer exposure device being located so as to conceal both said inner exposure device and said play results, said outer exposure device being removable to reveal the inner exposure device and only the play results result concealed by said inner exposure device.

2. The game ticket according to claim 1, wherein all play results concealed by said inner exposure device are of a first play result format, and all play results not covered by said inner exposure device are of play result formats other than the first play result format.

3. The game ticket according to claim 2, wherein said outer exposure device comprises a top card located over the playing surface of said base card, where said top card contains perforations defining one or more pull-tabs concealing all of said play results.

4. The game ticket according to claim 3, wherein said inner exposure device comprises a layer of a scratch-off covering applied to the playing surface of said base card.

5. The game ticket according to claim 4, wherein there are more than two play results.

6. The game ticket according to claim 5, wherein the first play result format displays a direct play result, and wherein all other play results are encoded in a slot machine play result format.

* * * * *